US012616246B2

(12) United States Patent
Taurino

(10) Patent No.: US 12,616,246 B2
(45) Date of Patent: May 5, 2026

(54) HEATER ASSEMBLY HAVING FLUID PERMEABLE HEATER WITH DIRECTLY DEPOSITED TRANSPORT MATERIAL

(71) Applicant: Philip Morris Products S.A., Neuchâtel (CH)

(72) Inventor: Irene Taurino, Neuchâtel (CH)

(73) Assignee: Philip Morris Products S.A., Neuchâtel (CH)

( * ) Notice: Subject to any disclaimer, the term of this patent is extended or adjusted under 35 U.S.C. 154(b) by 388 days.

(21) Appl. No.: 18/001,669

(22) PCT Filed: Jun. 17, 2021

(86) PCT No.: PCT/EP2021/066517
§ 371 (c)(1),
(2) Date: Dec. 13, 2022

(87) PCT Pub. No.: WO2021/255209
PCT Pub. Date: Dec. 23, 2021

(65) Prior Publication Data

US 2023/0329341 A1 Oct. 19, 2023

(30) Foreign Application Priority Data

Jun. 18, 2020 (EP) ..... 20180927

(51) Int. Cl.
*A24F 40/44* (2020.01)
*A24F 40/10* (2020.01)
(Continued)

(52) U.S. Cl.
CPC ..... *A24F 40/46* (2020.01); *A24F 40/10* (2020.01); *A24F 40/42* (2020.01)

(58) Field of Classification Search
CPC ..... A24F 40/10; A24F 40/42; A24F 40/44; A24F 40/46
See application file for complete search history.

(56) References Cited

U.S. PATENT DOCUMENTS 11,974,604 B2 * 5/2024 Frederick ..... A24F 40/70
12,193,503 B2 * 1/2025 Courbat ..... A24F 40/42
(Continued)

FOREIGN PATENT DOCUMENTS

CN 1905215 A 1/2007
CN 102154675 A 8/2011
(Continued)

OTHER PUBLICATIONS

International Search Report issued Sep. 21, 2021, in PCT/EP2021/066517, filed on Jun. 17, 2021, 3 pages.
(Continued)

*Primary Examiner* — Abdullah A Riyami
*Assistant Examiner* — Thang H Nguyen
(74) *Attorney, Agent, or Firm* — Oblon, McClelland, Maier & Neustadt, L.L.P.

(57) ABSTRACT

A heater assembly is provided for an aerosol-generating system, the heater assembly including: a fluid permeable heating element configured to heat a liquid aerosol-forming substrate to form an aerosol, the fluid permeable heating element including a plurality of apertures configured to allow fluid to permeate through the fluid permeable heating element; and a transport material including a plurality of channels configured to convey a liquid aerosol-forming substrate to the plurality of apertures of the fluid permeable heating element, the transport material including a ceramic, which is deposited directly on to a fluid permeable surface of the fluid permeable heating element, and for over 50 percent of the apertures of the fluid permeable heating element, the transport material further includes a corresponding channel configured to convey liquid aerosol-forming substrate to its respective aperture.

15 Claims, 3 Drawing Sheets

(51) Int. Cl.
*A24F 40/42* (2020.01)
*A24F 40/46* (2020.01)

(56) References Cited

U.S. PATENT DOCUMENTS

| | | | | |
|---|---|---|---|---|
| 2018/0020737 | A1* | 1/2018 | Mironov | F16T 1/00 131/329 |
| 2018/0168225 | A1* | 6/2018 | Zinovik | A24F 40/44 |
| 2020/0260787 | A1 | 8/2020 | Zinovik et al. | |
| 2021/0045441 | A1 | 2/2021 | Zinovik et al. | |
| 2024/0268464 | A1* | 8/2024 | Frederick | A24F 40/485 |

FOREIGN PATENT DOCUMENTS

| | | | | |
|---|---|---|---|---|
| CN | 110 063 523 | A | 7/2019 | |
| CN | 111031824 | A | 4/2020 | |
| CN | 111053291 | A | 4/2020 | |
| CN | 111207439 | A | 5/2020 | |
| JP | 2014-143129 | A | 8/2014 | |
| JP | 2017-506076 | A | 3/2017 | |
| KZ | 32570 | B | 12/2017 | |
| RU | 2 680 428 | C2 | 2/2019 | |
| WO | WO 2015/117702 | A1 | 8/2015 | |
| WO | WO-2019229197 | A1 * | 12/2019 | A24F 40/46 |
| WO | WO-2020065077 | A1 * | 4/2020 | A24F 40/46 |
| WO | WO 2021/151927 | A1 | 8/2021 | |
| WO | WO-2021151935 | A2 * | 8/2021 | H05B 6/02 |

OTHER PUBLICATIONS

Written Opinion issued Sep. 21, 2021, in PCT/EP2021/066517, filed on Jun. 17, 2021, 5 pages.
Combined Russian Office Action and Search Report issued Oct. 16, 2024 in Russian Patent Application No. 2023100840/03 (with Partial English Translation), 8 pages.
Extended European Search Report issued Dec. 14, 2020, in corresponding European Patent Application No. 20180927.4, 9 pages.
Japanese Office Action issued Apr. 28, 2025 in Japanese Patent Application No. 2022-575772, (with unedited computer-generated English translation), 10 pages.
Philippine Office Action issued Jul. 1, 2025 in corresponding Philippine Patent Application No. 1-2022-553418. 7 pages.
Office Action dated Mar. 1, 2026 issued in corresponding Chinese patent application No. 202180042830.9 (with English translation).

* cited by examiner

HEATER ASSEMBLY HAVING FLUID PERMEABLE HEATER WITH DIRECTLY DEPOSITED TRANSPORT MATERIAL

The present invention relates to a heater assembly for an aerosol-generating system. In particular, but not exclusively, the present invention relates to a heater assembly for a handheld electrically operated aerosol-generating system for heating an aerosol-forming substrate to generate an aerosol and for delivering the aerosol into the mouth of a user. The present invention also relates to a cartridge for an aerosol-generating system comprising the heater assembly, an aerosol-generating system and a method of manufacturing the heater assembly.

Handheld electrically operated aerosol-generating devices and systems are known that consist of a device portion comprising a battery and control electronics, a portion for containing or receiving a liquid aerosol-forming substrate and an electrically operated heater for heating the aerosol-forming substrate to generate an aerosol. The heater typically comprises a coil of wire which is wound around an elongate wick which transfers liquid aerosol-forming substrate from the liquid storage portion to the heater. An electric current can be passed through the coil of wire to heat the heater and thereby generate an aerosol from the aerosol-forming substrate. A mouthpiece portion is also included on which a user may puff to draw aerosol into their mouth.

In addition to the wick, the liquid storage portion may comprise an absorbent material for holding the liquid aerosol-forming substrate. Therefore, manufacturing a heater assembly for known aerosol-generating devices and providing a means of transporting liquid aerosol-forming substrate to the heating wire can involve the assembly of at least three components. This increases the complexity of the assembly line and the number of manufacturing steps involved.

Another problem with known aerosol-generating devices arises if a user continues to use an aerosol-generating device after the liquid aerosol-forming substrate has been depleted. In this situation, some materials used to form wicking materials have been known to degrade when they are heated in a dry condition and to release unwanted by-products which can be potentially harmful. Furthermore, some fibrous wicking materials have been known to release fibres when heated in a dry condition.

It would be desirable to provide a heater assembly for an aerosol-generating system which has fewer parts that need to be assembled. It would be desirable to provide a heater assembly for an aerosol-generating system which is simpler to manufacture. It would also be desirable to provide a heater assembly which reduces the risk of unwanted by-products being produced.

According to an example of the present disclosure, there is provided a heater assembly for an aerosol-generating system. The heater assembly may comprise a fluid permeable heating element for heating a liquid aerosol-forming substrate to form an aerosol. The heater assembly may comprise a transport material for conveying a liquid aerosol-forming substrate to the fluid permeable heating element. The transport material may comprise a ceramic. The ceramic may be deposited on to a fluid permeable surface of the fluid permeable heating element. The ceramic may be deposited directly on to a fluid permeable surface of the fluid permeable heating element.

According to an example of the present disclosure, there is provided a heater assembly for an aerosol-generating system, the heater assembly comprising: a fluid permeable heating element for heating a liquid aerosol-forming substrate to form an aerosol; and a transport material for conveying a liquid aerosol-forming substrate to the fluid permeable heating element, wherein the transport material comprises a ceramic which is deposited directly on to a fluid permeable surface of the fluid permeable heating element.

As used herein, the term "deposited" in intended to mean that the transport material is formed by some form of physical, chemical or electro-deposition process on a surface of the fluid permeable heating element. The term "deposited" is not intended to encompass forming the transport material as a separate discrete part which is merely attached to, or placed in contact with, the fluid permeable heating element. For the avoidance of doubt, the term "deposited" includes electrophoretic deposition.

As used herein, the term "deposited directly" means that the transport material is deposited on a surface of the fluid permeable heating element in direct contact with the fluid permeable heating element with no intervening components arranged between the transport material and the fluid permeable heating element.

Advantageously, by depositing the transport material directly on the fluid permeable heating element, the transport material is integrally formed with the fluid permeable heating element. In other words, the transport material and the fluid permeable heating element are formed as a single piece or part. Instead of two components, i.e. a separate transport material and a heating element, the heater assembly only comprises a single component. This reduces the number of discrete parts of the heater assembly that have to be assembled and makes assembly more straightforward. It also obviates the need for further components for assembling the heater assembly, for example, a frame or holder for keeping the components together. Furthermore, other components of the heater assembly can be connected directly to the heater assembly. For example, electrical contacts can be connected directly to the fluid permeable heating element. In addition, forming the fluid permeable heating element and transport material as a single integral component ensures the fluid permeable heating element is in fluid communication with the transport materials and assists in supplying liquid aerosol-forming substrate to the heating element.

An advantage of forming the transport material from a ceramic is that it mitigates some of the problems that may arise from using fibrous wicking materials such as the production of unwanted by-products caused by a dry heating situation. Compared to some polymer-based fibres, ceramics are relatively inert and are thermally and structurally stable over a wider temperature range. The use of a ceramic transport material also reduces the risk of releasing of fibre segments into the device.

The fluid permeable heating element may comprise a plurality of interstices or apertures extending from a first side to a second side of the heating element. The plurality of interstices or apertures advantageously allow fluid to permeate through the heating element.

The transport material may comprise a plurality of channels for conveying a liquid aerosol-forming substrate to the plurality of apertures of the fluid permeable heating element. Each channel of the plurality of channels may be a capillary channel which transfers liquid from one end of the transport material to another by means of capillary action. The transport material may comprise any suitable ceramic. The transport material may comprise any suitable inert ceramic or bio-compatible ceramic. Examples of suitable ceramics are $Al_2O_3$, $ZrO_2$ and calcium phosphate ceramics including hydroxyapatite.

For each of the apertures of the fluid permeable heating element, or at least for the majority (such as over 50 percent) of each of the apertures of the fluid permeable heating element, the transport material may comprise a corresponding channel for conveying liquid aerosol-forming substrate to its respective aperture. For over 60 percent, preferably for over 70 percent, and more preferably for over 80 percent of the apertures of the fluid permeable heating element, the transport material may comprise a corresponding channel for conveying liquid aerosol-forming substrate to its respective aperture. For between 50 percent and 85 percent, preferably for between 60 percent and 85 percent, and more preferably for between 70 percent and 85 percent of the apertures of the fluid permeable heating element, the transport material may comprise a corresponding channel for conveying liquid aerosol-forming substrate to its respective aperture. This means that each aperture, or at least each of a majority of the apertures, has its own dedicated channel which assists in supplying liquid aerosol-forming substrate to the fluid permeable heating element. It also means that liquid aerosol-forming substrate can be supplied to every aperture, or at least to the majority of the apertures. This assists in ensuring that every part of the fluid permeable heating element that has an aperture, or at least the majority of every part of the fluid permeable heating element that has an aperture, receives a supply of liquid aerosol-forming substrate and the supply is evenly distributed over the fluid permeable heating element.

The transport material may have a thickness defined between a first surface of the transport material and an opposing second surface of the transport material. The fluid permeable heating element may be arranged at the first surface and the second surface may be arranged to receive liquid aerosol-forming substrate. The plurality of channels may extend through the thickness of the transport material between the first and second surfaces of the transport material. The plurality of channels extending through the thickness of the transport material may assist in supplying liquid aerosol-forming substrate from a liquid storage portion to the fluid permeable heating element. The thickness of the transport material may be between 0.5 and 6 mm.

The plurality of channels may be arranged to permit flow of a liquid aerosol-forming substrate in a single direction between the first and second surfaces of the transport material. Advantageously, this may result in a more efficient transfer of liquid aerosol-forming substrate to the fluid permeable heating element. In a standard porous ceramic material the pores are interconnected in an isotropic manner and liquid can permeate in any direction through the ceramic and not necessarily towards the heating element. By providing channels through the ceramic, liquid is encouraged to flow through the transport material in a single direction, i.e. from a second surface where liquid aerosol-forming substrate is received to the fluid permeable heating element The plurality of channels may extend substantially linearly in a direction substantially orthogonal to the first surface of the transport material. Advantageously, this may result in a more efficient transfer of liquid aerosol-forming substrate to the fluid permeable heating element because the liquid is taking the shortest route to the fluid permeable heating element, that is, a straight line.

Each of the plurality of apertures of the fluid permeable heating element may have a cross-sectional dimension between 20 microns and 300 microns. This has been found to be a particularly effective size range for allowing liquid aerosol-forming substrate to permeate into the apertures of the fluid permeable heating element and particularly effective aerosol-generation upon heating by the fluid permeable heating element.

Preferably, each of the plurality of apertures of the fluid permeable heating element may have a cross-sectional dimension between 20 microns and 200 microns, more preferably between 20 microns and 100 microns, more preferably between 50 microns and 80 microns and yet more preferably of about 70 microns.

The transverse cross-sectional dimensions of each of the plurality of channels along the length of the channels may be substantially the same as the cross-sectional dimensions of the apertures of the fluid permeable heating element. This allows unimpeded flow of liquid aerosol-forming substrate through the channels.

The transverse cross-sectional dimensions of each of the plurality of channels along the length of the channels may be substantially the same as the cross-sectional dimensions of its corresponding aperture of the fluid permeable heating element. This allows unimpeded flow of liquid aerosol-forming substrate through the channels.

The heater assembly may further comprise electrical contacts for supplying electrical power to the fluid permeable heating element. The electrical contacts may be directly connected to the fluid permeable heating element. Advantageously, by directly connecting the electrical contacts to the fluid permeable heating element, the number of components that have to be assembled and connected on an assembly line is further reduced.

The electrical contacts may be positioned on opposite ends of the fluid permeable heating element. The electrical contact portions may comprise two electrically conductive contact pads. The electrically conductive contact pads may be positioned at an edge area of the fluid permeable heating element. Preferably, the at least two electrically conductive contact pads may be positioned on extremities of the heating element. An electrically conductive contact pad may be fixed directly to electrically conductive filaments of the fluid permeable heating element. An electrically conductive contact pad may comprise a tin patch. Alternatively, an electrically conductive contact pad may be integral with the fluid permeable heating element.

The transport material may comprises a first transport material arranged on a first side of the fluid permeable heating element. The heater assembly may further comprise a second transport material arranged on a second side of the fluid permeable heating element. This effectively sandwiches the fluid permeable heating between the first and second transport materials, which may assist in improving the robustness of the heater assembly.

The fluid permeable heating element may comprise an electrically resistive heating element.

The fluid permeable heating element may be made from any suitable electrically conductive material. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, constantan, nickel-, cobalt-, chromium-, aluminum-, titanium-, zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminum based alloys and iron-manganese-aluminum based alloys. Timetal® is a registered trade mark of Titanium Metals Corporation. Preferably, the fluid permeable heating element is made from stainless steel, more preferably 300 series stainless steel like AISI 304, 316, 304L, 316L.

Additionally, the fluid permeable heating element may comprise combinations of the above materials. A combination of materials may be used to improve the control of the resistance of the substantially flat heating element. For example, materials with a high intrinsic resistance may be combined with materials with a low intrinsic resistance. This may be advantageous if one of the materials is more beneficial from other perspectives, for example price, machinability or other physical and chemical parameters. Advantageously, high resistivity heaters allow more efficient use of battery energy.

The fluid permeable heating element may comprise a substantially flat heating element to allow for simple manufacture. Geometrically, the term "substantially flat" heating element is used to refer to a heating element that is in the form of a substantially two dimensional topological manifold. In some examples, the substantially flat heating element may extend in two dimensions along a surface substantially more than in a third dimension. In some examples, the dimensions of the substantially flat heating element in the two dimensions within the surface may be at least five times larger than in the third dimension, normal to the surface. In some examples, the substantially flat fluid permeable heating element may comprise two substantially imaginary parallel flat surfaces. In some examples, the substantially flat heating element may be a structure between two substantially imaginary parallel flat surfaces, wherein the distance between these two imaginary surfaces is substantially smaller than the extension within the surfaces. In some examples, only one of the two substantially imaginary parallel surfaces may be flat. In some examples, the substantially flat heating element may be planar. In other examples, the substantially flat heating element may be curved along one or more dimensions, for example forming a dome shape or bridge shape.

The fluid permeable heating element may comprise one, or a plurality of electrically conductive filaments. The term "filament" is used to refer to an electrical path arranged between two electrical contacts. A filament may arbitrarily branch off and diverge into several paths or filaments, respectively, or may converge from several electrical paths into one path. A filament may have a round, square, flat or any other form of cross-section. A filament may be arranged in a straight or curved manner.

The fluid permeable heating element may be an array of filaments, for example arranged parallel to each other. Preferably, the filaments may form a mesh. The mesh may be woven or non-woven. The mesh may be formed using different types of weave or lattice structures. Alternatively, the electrically conductive heating element comprises an array of filaments or a fabric of filaments. The mesh, array or fabric of electrically conductive filaments may also be characterized by its ability to retain liquid.

In a preferred example, a substantially flat heating element may be constructed from a wire that is formed into a wire mesh. Preferably, the mesh has a plain weave design. Preferably, the heating element is a wire grill made from a mesh strip.

The electrically conductive filaments may define interstices between the filaments and the interstices may have a width of between 10 micrometres and 100 micrometres. Preferably, the filaments give rise to capillary action in the interstices, so that in use, liquid to be vaporized is drawn into the interstices, increasing the contact area between the heating element and the liquid aerosol-forming substrate.

The electrically conductive filaments may form a mesh of size between 60 and 240 filaments per centimetre (+/−10 percent). Preferably, the mesh density is between 100 and 140 filaments per centimetres (+/−10 percent). More preferably, the mesh density is approximately 115 filaments per centimetre. The width of the interstices may be between 20 micrometres and 300 micrometres, preferably between 50 micrometres and 100 micrometres, more preferably approximately 70 micrometres. The percentage of open area of the mesh, which is the ratio of the area of the interstices to the total area of the mesh may be between 40 percent and 90 percent, preferably between 85 percent and 80 percent, more preferably approximately 82 percent.

The electrically conductive filaments may have a width or diameter of between 10 micrometres and 100 micrometres, preferably between 10 micrometres and 50 micrometres, more preferably between 12 micrometres and 25 micrometres, and most preferably approximately 16 micrometres. The filaments may have a round cross section or may have a flattened cross-section.

The area of the mesh, array or fabric of electrically conductive filaments may be small, for example less than or equal to 50 square millimetres, preferably less than or equal to 25 square millimetres, more preferably approximately 15 square millimetres. The size is chosen such to incorporate the heating element into a handheld system. Sizing of the mesh, array or fabric of electrically conductive filaments less or equal than 50 square millimetres reduces the amount of total power required to heat the mesh, array or fabric of electrically conductive filaments while still ensuring sufficient contact of the mesh, array or fabric of electrically conductive filaments to the liquid aerosol-forming substrate. The mesh, array or fabric of electrically conductive filaments may, for example, be rectangular and have a length between 2 millimetres to 10 millimetres and a width between 2 millimetres and 10 millimetres. Preferably, the mesh has dimensions of approximately 5 millimetres by 3 millimetres.

Preferably, the filaments are made of wire. More preferably, the wire is made of metal, most preferably made of stainless steel.

The electrical resistance of the mesh, array or fabric of electrically conductive filaments of the heating element may be between 0.3 Ohms and 4 Ohms. Preferably, the electrical resistance is equal or greater than 0.5 Ohms. More preferably, the electrical resistance of the mesh, array or fabric of electrically conductive filaments is between 0.6 Ohms and 0.8 Ohms, and most preferably about 0.68 Ohms. The electrical resistivity of the mesh, array or fabric of electrically conductive filaments is preferably at least an order of magnitude, and more preferably at least two orders of magnitude, greater than the electrical resistivity of any electrically conductive contact portions. This ensures that the heat generated by passing current through the heating element is localized to the mesh or array of electrically conductive filaments. It is advantageous to have a low overall resistance for the heating element if the system is powered by a battery. A low resistance, high current system allows for the delivery of high power to the heating element. This allows the heating element to heat the electrically conductive filaments to a desired temperature quickly.

Alternatively, the fluid permeable heating element may comprise a heating plate or membrane in which an array of apertures is formed. The apertures may be formed by etching or machining, for example. The plate or membrane may be formed from any material with suitable electrical properties, such as the materials described above in relation to the fluid permeable heating element.

According to another example of the present disclosure, there is provided a cartridge for an aerosol-generating system. The cartridge may comprise a heater assembly according to any of the example heater assemblies described above. The cartridge may comprise a liquid storage portion or compartment for holding a liquid aerosol-forming substrate.

According to another example of the present disclosure, there is provided a cartridge for an aerosol-generating system, the cartridge comprising a heater assembly according to any of the example heater assemblies described above and a liquid storage portion or compartment for holding a liquid aerosol-forming substrate.

The terms "liquid storage portion" and "liquid storage compartment" are used interchangeably herein. The liquid storage portion or compartment may have first and second storage portions in communication with one another. A first storage portion of the liquid storage compartment may be on an opposite side of the heater assembly to the second storage portion of the liquid storage compartment. Liquid aerosol-forming substrate is held in both the first and second storage portions of the liquid storage compartment.

Advantageously, the first storage portion of the storage compartment is larger than the second storage portion of the liquid storage compartment. The cartridge may be configured to allow a user to draw or suck on the cartridge to inhale aerosol generated in the cartridge. In use a mouth end opening of the cartridge is typically positioned above the heater assembly, with the first storage portion of the storage compartment positioned between the mouth end opening and the heater assembly. Having the first storage portion of the liquid storage compartment larger than the second storage portion of the liquid storage compartment ensures that liquid is delivered from the first storage portion of the liquid storage compartment to the second storage portion of the liquid storage compartment, and so to the heater assembly, during use, under the influence of gravity.

The cartridge may have a mouth end through which generated aerosol can be drawn by a user and a connection end configured to connect to an aerosol-generating device, wherein a first side of the heater assembly faces the mouth end and a second side of the heater assembly faces the connection end.

The cartridge may define an enclosed airflow path or passage from an air inlet past the first side of the heater assembly to a mouth end opening of the cartridge. The enclosed airflow passage may pass through the first or second storage portion of the liquid storage compartment. In one embodiment the airflow path extends between the first and second storage portions of the liquid storage compartment. Additionally, the air flow passage may extend through the first storage portion of the liquid storage compartment. For example, the first storage portion of the liquid storage compartment may have an annular cross section, with the air flow passage extending from the heater assembly to the mouth end portion through the first storage portion of the liquid storage compartment. Alternatively, the airflow passage may extend from the heater assembly to the mouth end opening adjacent to the first storage portion of the liquid storage compartment.

Alternatively, or in addition, the cartridge may contain a retention material for holding a liquid aerosol-forming substrate. The retention material may be in the first storage portion of the liquid storage compartment, the second storage portion of the liquid storage compartment or both the first and second storage portions of the liquid storage compartment. The retention material may be a foam, a sponge or a collection of fibres. The retention material may be formed from a polymer or co-polymer. In one embodiment, the retention material is a spun polymer. The liquid aerosol-forming substrate may be released into the retention material during use. For example, the liquid aerosol-forming substrate may be provided in a capsule.

The cartridge advantageously contains liquid aerosol-forming substrate. As used herein, the term "aerosol-forming substrate" refers to a substrate capable of releasing volatile compounds that can form an aerosol. Volatile compounds may be released by heating the aerosol-forming substrate.

The aerosol-forming substrate may be liquid at room temperature. The aerosol-forming substrate may comprise both liquid and solid components. The liquid aerosol-forming substrate may comprise nicotine. The nicotine containing liquid aerosol-forming substrate may be a nicotine salt matrix. The liquid aerosol-forming substrate may comprise plant-based material. The liquid aerosol-forming substrate may comprise tobacco. The liquid aerosol-forming substrate may comprise a tobacco-containing material containing volatile tobacco flavour compounds, which are released from the aerosol-forming substrate upon heating. The liquid aerosol-forming substrate may comprise homogenised tobacco material. The liquid aerosol-forming substrate may comprise a non-tobacco-containing material. The liquid aerosol-forming substrate may comprise homogenised plant-based material.

The liquid aerosol-forming substrate may comprise one or more aerosol-formers. An aerosol-former is any suitable known compound or mixture of compounds that, in use, facilitates formation of a dense and stable aerosol and that is substantially resistant to thermal degradation at the temperature of operation of the system. Examples of suitable aerosol formers include glycerine and propylene glycol. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. The liquid aerosol-forming substrate may comprise water, solvents, ethanol, plant extracts and natural or artificial flavours.

The liquid aerosol-forming substrate may comprise nicotine and at least one aerosol-former. The aerosol-former may be glycerine or propylene glycol. The aerosol former may comprise both glycerine and propylene glycol. The liquid aerosol-forming substrate may have a nicotine concentration of between about 0.5% and about 10%, for example about 2%.

The cartridge may comprise a housing. The housing may be formed form a mouldable plastics material, such as polypropylene (PP) or polyethylene terephthalate (PET). The housing may form a part or all of a wall of one or both portions of the liquid storage compartment. The housing and liquid storage compartment may be integrally formed. Alternatively the liquid storage compartment may be formed separately from the housing and assembled to the housing.

According to another example of the present disclosure, there is provided an aerosol-generating system. The aerosol-generating system may comprise a cartridge according to any of the example cartridges described above. The aerosol-generating system may comprise an aerosol-generating device. The cartridge may be removably coupled to the aerosol-generating device. The aerosol-generating device may comprise a power supply for the heater assembly.

According to another example of the present disclosure, there is provided an aerosol-generating system comprising: a cartridge according to any of the example cartridges described above; and an aerosol-generating device; wherein the cartridge is removably coupled to the aerosol-generating device, and wherein the aerosol-generating device comprises a power supply for the heater assembly.

The aerosol-generating device may further comprise control circuitry configured to control a supply of electrical power to the heater assembly.

The control circuitry may comprise a microprocessor. The microprocessor may be a programmable microprocessor, a microcontroller, or an application specific integrated chip (ASIC) or other electronic circuitry capable of providing control. The control circuitry may comprise further electronic components. For example, in some embodiments, the control circuitry may comprise any of: sensors, switches, display elements. Power may be supplied to the heater assembly continuously following activation of the device or may be supplied intermittently, such as on a puff-by-puff basis. The power may be supplied to the heater assembly in the form of pulses of electrical current, for example, by means of pulse width modulation (PWM).

The power supply may be a DC power supply. The power supply may be a battery. The battery may be a Lithium based battery, for example a Lithium-Cobalt, a Lithium-Iron-Phosphate, a Lithium Titanate or a Lithium-Polymer battery. The battery may be a Nickel-metal hydride battery or a Nickel cadmium battery. The power supply may be another form of charge storage device such as a capacitor. The power supply may be rechargeable and be configured for many cycles of charge and discharge. The power supply may have a capacity that allows for the storage of enough energy for one or more user experiences; for example, the power supply may have sufficient capacity to allow for the continuous generation of aerosol for a period of about six minutes, corresponding to the typical time taken to smoke a conventional cigarette, or for a period that is a multiple of six minutes. In another example, the power supply may have sufficient capacity to allow for a predetermined number of puffs or discrete activations of the heater assembly.

The aerosol-generating device may comprise a housing. The housing may be elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. The material is preferably light and non-brittle.

The aerosol-generating system may be a handheld aerosol-generating system. The aerosol-generating system may be a handheld aerosol-generating system configured to allow a user to puff on a mouthpiece to draw an aerosol through a mouth end opening. The aerosol-generating system may have a size comparable to a conventional cigar or cigarette. The aerosol-generating system may have a total length between about 30 mm and about 150 mm. The aerosol-generating system may have an external diameter between about 5 mm and about 30 mm.

According to another example of the present disclosure, there is provided a method of manufacturing a heater assembly for an aerosol-generating system. The method may comprise providing a fluid permeable heating element. The method may comprise providing a transport material for transporting liquid aerosol-forming substrate to the fluid permeable heating element. The transport material may be provided by depositing a ceramic on the fluid permeable heating element. The transport material may be provided by depositing a ceramic directly on the fluid permeable heating element.

According to another example of the present disclosure, there is provided a method of manufacturing a heater assembly for an aerosol-generating system, the method comprising: providing a fluid permeable heating element, providing a transport material for transporting liquid aerosol-forming substrate to the fluid permeable heating element; wherein the transport material is provided by depositing a ceramic directly on the fluid permeable heating element.

Advantageously, by depositing the transport material directly on the fluid permeable heating element, the transport material is integrally formed with the fluid permeable heating element. In other words, the transport material and the fluid permeable heating element are formed as a single piece or part. The transport material and the fluid permeable heating element are formed as a single piece or part in a single manufacturing step. Instead of two components, i.e. a separate transport material and a heating element, the heater assembly only comprises a single component. This reduces the number of discrete parts of the heater assembly that have to be assembled and makes assembly more straightforward. It also obviates the need for further components for assembling the heater assembly, for example, a frame or holder for keeping the components together. Furthermore, other components of the heater assembly can be connected directly to the heater assembly. For example, electrical contacts can be connected directly to the fluid permeable heating element.

The transport material may be deposited directly on to the fluid permeable heating element by electrophoretic deposition.

As used herein, the term "electrophoretic deposition" refers to a process in which colloidal particles suspended in a liquid medium migrate under the influence of an electric field (electrophoresis) and are deposited onto conductive substrates such as the fluid permeable heating element which acts as an electrode.

Electrophoretic deposition may assist in imparting a number of characteristics to the heater assembly. Advantageously, the ceramic transport material binds to the fluid permeable heating element to produce a single piece heater assembly comprising the fluid permeable heating element and an integral transport material. The ceramic transport material will be deposited in the shape of the underlying fluid permeable heating element, which acts as an electrode in the electrophoretic deposition process. Furthermore, the deposited ceramic transport material will maintain this shape as the thickness of the deposited ceramic layer increases during the deposition process. Consequently, the ceramic transport material will have substantially linear channels extending away from the fluid permeable heating element. The channels will have substantially the same shape and dimensions as the underlying apertures in the fluid permeable heating element. Thus, the channels will allow unidirectional liquid flow through the transport material towards the fluid permeable heating element by capillary action.

The transport material may be deposited by depositing ceramic particles on to the fluid permeable heating element, wherein an average particle size of the ceramic particles is between 0.05 microns and 0.7 microns. This range of particle sizes for the ceramic particles has been found to be a particularly effective for producing a transport material having suitable properties.

The particle size of the ceramic particles may depend on the type of ceramic used. For example, for inert ceramics such as $Al_2O_3$ and $ZrO_2$ the particle size may be between 02 and 0.7 microns. For bio-compatible ceramics such as hydroxyapatite, the particle size may be between 50 to 600 nanometres.

The method may use particles of different types of ceramic to build up different ceramic layers within the deposited transport material. Different types of ceramic could be used to impart different properties to the transport material.

The method may further comprise annealing the heater assembly after the transport material has been deposited. The method may further comprise sintering the heater assembly after the transport material has been deposited. Sintering causes the ceramic particles to coalesce and the pores or spaces between the ceramic particles to be reduced. This may assist in reducing lateral flow of liquid aerosol-forming substrate out of the channels through the body of the ceramic and instead maintains the liquid aerosol-forming substrate in the channels so that the liquid efficiently flows in the channels to the apertures in the fluid permeable heating element.

The invention is defined in the claims. However, below there is provided a non-exhaustive list of non-limiting examples. Any one or more of the features of these examples may be combined with any one or more features of another example, embodiment, or aspect described herein.

Example Ex1: A heater assembly for an aerosol-generating system, the heater assembly comprising: a fluid permeable heating element for heating a liquid aerosol-forming substrate to form an aerosol; and a transport material for conveying a liquid aerosol-forming substrate to the fluid permeable heating element.

Example Ex2: A heater assembly according to example Ex1, wherein the transport material comprises a ceramic which is deposited directly on to a fluid permeable surface of the fluid permeable heating element.

Example Ex3: A heater assembly according to example Ex1 or example Ex2, wherein the fluid permeable heating element comprises a plurality of apertures to allow fluid to permeate through the heating element.

Example Ex4: A heater assembly according to example Ex3, wherein the transport material comprises a plurality of channels for conveying a liquid aerosol-forming substrate to the plurality of apertures of the fluid permeable heating element.

Example Ex5: A heater assembly according to example Ex4, wherein, for each of the apertures of the fluid permeable heating element, the transport material comprises a corresponding channel for conveying liquid aerosol-forming substrate to its respective aperture.

Example Ex6: A heater assembly according to any preceding example, wherein the transport material has a thickness defined between a first surface of the transport material and an opposing second surface of the transport material, wherein the fluid permeable heating element is arranged at the first surface and the second surface is arranged to receive liquid aerosol-forming substrate, wherein the plurality of channels extend through the thickness of the transport material between the first and second surfaces of the transport material.

Example Ex7: A heater assembly according to example Ex6, wherein the plurality of channels are arranged to permit flow of a liquid aerosol-forming substrate in a single direction between the first and second surfaces of the transport material.

Example Ex8: A heater assembly according to example Ex6 or example Ex7, wherein the plurality of channels extend substantially linearly in a direction substantially orthogonal to the first surface of the transport material.

Example Ex9: A heater assembly according to any preceding example, wherein each of the plurality of apertures of the fluid permeable heating element has a cross-sectional dimension between 20 microns and 300 microns.

Example Ex10: A heater assembly according to any of examples Ex5 to Ex9, wherein the transverse cross-sectional dimensions of each of the plurality of channels along the length of the channels are substantially the same as the cross-sectional dimensions of its corresponding aperture of the fluid permeable heating element.

Example Ex11: A heater assembly according to any preceding example, further comprising electrical contacts for supplying electrical power to the fluid permeable heating element, wherein the electrical contacts are directly connected to the fluid permeable heating element.

Example Ex12: A heater assembly according to any preceding example, wherein the fluid permeable heating element is substantially flat.

Example Ex13: A heater assembly according to any preceding example, wherein the transport material comprises a ceramic selected from one or more of aluminium oxide, zirconium oxide and hydroxyapatite.

Example Ex14: A heater assembly according to any of examples Ex5 to Ex13, wherein each aperture of the fluid permeable heating element is substantially aligned with its corresponding channel.

Example Ex15: A heater assembly according to any of examples Ex4 to Ex14, wherein the transverse cross-sectional shape of the channels is substantially the same as the transverse cross-sectional shape of the apertures.

Example Ex16: A heater assembly according to any of examples Ex11 to Ex15, wherein the electrical contacts are arranged on opposite sides of the fluid permeable heating element.

Example Ex17: A heater assembly according to any preceding example, wherein the transport material comprises a first transport material arranged on a first side of the fluid permeable heating element, wherein the heater assembly comprises a second transport material arranged on a second side of the fluid permeable heating element.

Example Ex18: A heater assembly according to any preceding example, wherein the fluid permeable heating element comprises a mesh heater comprising a plurality of intersecting heating filaments.

Example Ex19: A heater assembly according to example Ex18, wherein a width or diameter of the heating filaments is between 10 and 100 microns.

Example Ex20: A cartridge for an aerosol-generating system, the cartridge comprising a heater assembly according to any of the preceding examples and a liquid storage portion for holding a liquid aerosol-forming substrate.

Example Ex21: An aerosol-generating system comprising: a cartridge according to example Ex20; and an aerosol-generating device; wherein the cartridge is removably coupled to the aerosol-generating device, and wherein the aerosol-generating device comprises a power supply for the heater assembly.

Example Ex22: A method of manufacturing a heater assembly for an aerosol-generating system, the method comprising: providing a fluid permeable heating element; providing a transport material for transporting liquid aerosol-forming substrate to the fluid permeable heating element.

Example Ex23: A method according to example Ex22, wherein the transport material is provided by depositing a ceramic directly on the fluid permeable heating element.

Example Ex24: A method according to example Ex23, wherein the transport material is directly deposited on to the fluid permeable heating element by electrophoretic deposition.

Example Ex25: A method according to example Ex23 or example Ex24, wherein the transport material is deposited by depositing ceramic particles on to the fluid permeable heating element, wherein an average particle size of the ceramic particles is between 0.05 microns and 0.7 microns.

Example Ex26: A method according to any of examples Ex23 to Ex25, further comprising sintering the heater assembly after the transport material has been deposited.

Examples will now be further described with reference to the figures in which.

Figure 1:
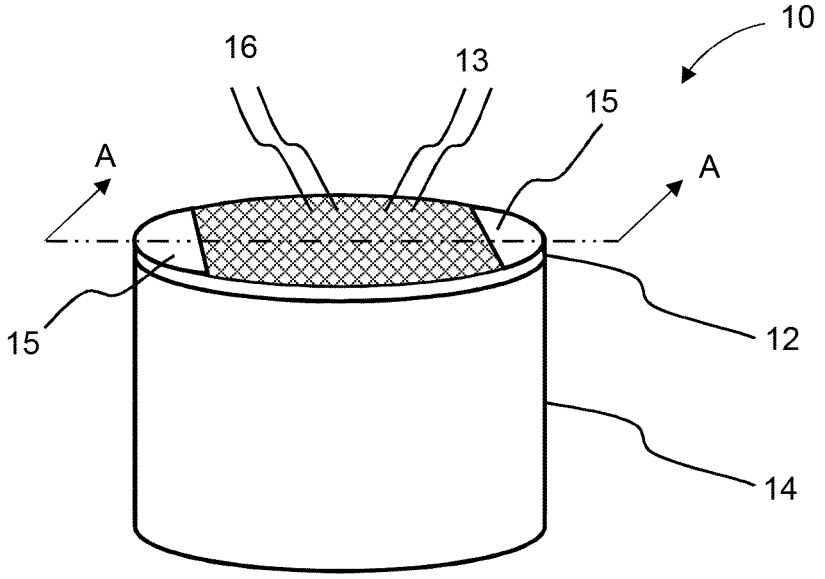
FIG. 1 is a schematic perspective view of a heater assembly in accordance with an example of the present disclosure.

Referring to FIG. 1, there is shown a heater assembly 10 comprising a mesh heating element 12 and a ceramic transport material 14. The mesh heating element 12 comprises an array of electrically conductive filaments 13 made from stainless steel and is fluid permeable. The ceramic transport material 14 has been deposited directly on to a fluid permeable bottom surface (not shown in FIG. 1) of the mesh heating element 12 by electrophoretic deposition. Any suitable ceramic can be used to form the transport material 14 and examples of suitable ceramics are discussed below.

The ceramic transport material 14 is fixedly attached to the bottom surface of the mesh heating element 12 to form a single piece heater assembly 10. The ceramic transport material 14 is arranged to convey a liquid aerosol-forming substrate (not shown) to the mesh heating element 12. A plurality of interstices or apertures 16 are defined between the filaments 13 of the mesh heating element 12. During heating, vaporised aerosol-forming substrate can be released from the heater assembly 10 via the apertures 16 to generate an aerosol.

The heater assembly 10 further comprises a pair of electrical contacts 15 for supplying electrical power to the mesh heating element 12. The electrical contacts 15 comprise a pair of tin pads which are bonded directly to the mesh heating element and are arranged on opposing sides of the mesh. Whilst the electrical contacts cover some of the apertures of the mesh heating element 12, this amounts to only a small proportion of the total number of apertures of the mesh heating element and does not significantly affect aerosol generation.

Figure 2:
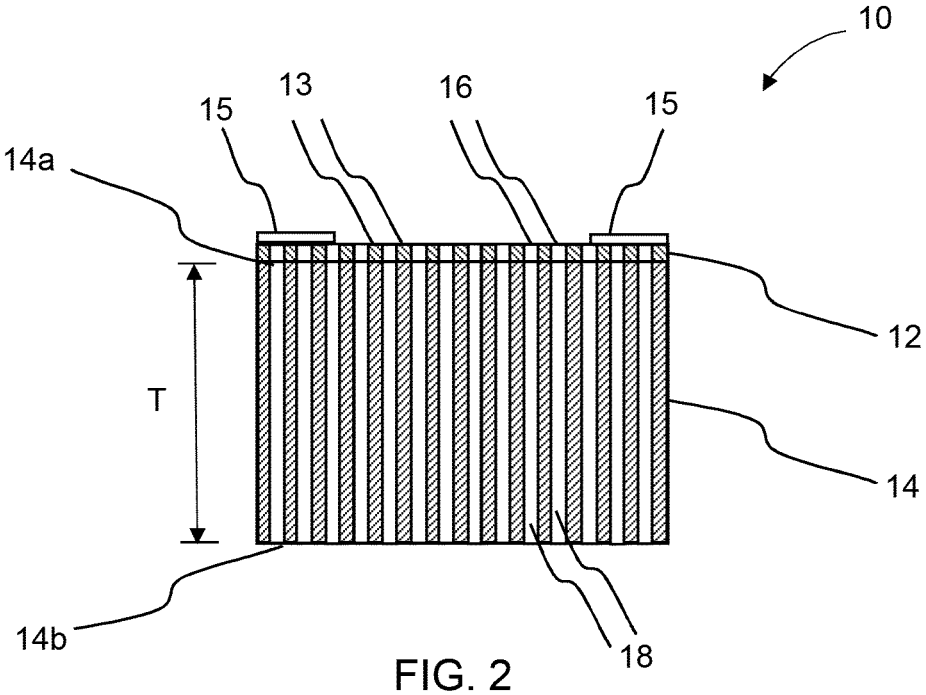
FIG. 2 is schematic side cross-sectional view of the heater assembly of FIG. 1 taken along the line A-A in FIG. 1.

FIG. 2 shows a cross-sectional view through the heater assembly 10 taken along the line A-A of FIG. 1. The mesh heating element 12 is arranged at a first surface 14*a* of the ceramic transport material 14. An opposing second surface 14*b* of the ceramic transport material 14 is arranged to receive or contact a liquid aerosol-forming substrate. The ceramic transport material 14 comprises a plurality of channels 18 for conveying a liquid aerosol-forming substrate to the plurality of apertures 16 arranged between the filaments 13 of the mesh heating element 12. The plurality of channels 18 extend through the thickness T of the ceramic transport material 14 between the first 14*a* and second 14*b* surfaces of the ceramic transport material 14. For each of the apertures 16 of the mesh heating element 12, the ceramic transport material 14 comprises a corresponding channel 18 for conveying liquid aerosol-forming substrate to its respective aperture 16. It should be noted that FIG. 2 is not to scale. For clarity, the channels 18, filaments 13 and apertures 16 have been enlarged and fewer channels 18, filaments 13 and apertures 16 are shown than would be present in an actual heater assembly.

As discussed in more detail below, the ceramic transport material 14 has been formed by electrophoretic deposition of ceramic particles on the mesh heating element 12. As the ceramic transport material 14 is deposited it assumes the same shape and dimensions as the mesh heating element 12 because the ceramic particles are only deposited on the electrically conductive filaments 13 of mesh heating element 12 and not in the space of the apertures 16. Therefore, as the thickness T of the deposited ceramic transport material 14 increases during the electrophoretic deposition process, a plurality of channels 18 is formed through the thickness T of the ceramic transport material, each channel 18 corresponding to its respective aperture 16. It will be appreciated that, due to manufacturing tolerances in the electrophoretic deposition process, a clear channel 18 through the thickness T of the transport material 14 may not be formed for every single aperture 16 of the heating element 12. However, a channel 18 will be formed for a majority of the apertures 16, that is, for over 50 percent of the apertures 16 and, generally, the proportion of apertures 16 for which a channel 18 is formed is much higher, for example, for over 80 or 90 percent of the apertures 16.

The plurality of channels 18 extend substantially linearly in a direction substantially orthogonal to the first surface 14*a* of the ceramic transport material. Following electrophoretic deposition of the ceramic transport material 14, the heater assembly is typically sintered, which causes the ceramic particles to coalesce and reduces the size of any pores between the particles. This assists in reducing lateral flow of the liquid aerosol-forming substrate out of the channels through the body of the ceramic and instead maintains the liquid aerosol-forming substrate in the channels 18. Therefore, the plurality of channels 18 permit flow of a liquid aerosol-forming substrate in a single direction from the second surface 14*b* of the ceramic transport material 14, which receives or is in contact with a liquid aerosol-forming substrate, to the first surface 14*a* of the ceramic transport material 14 at which the mesh heating element 12 is arranged.

As can be seen in FIG. 2, the transverse cross-sectional dimensions of each of the plurality of channels 18 along the length of the channels are substantially the same as the cross-sectional dimensions of the channel's corresponding aperture 16 in the mesh heating element 12. Depending on the spacing of the filaments 13 of the mesh heating element 12, the apertures 16 can have a cross-sectional dimension of between 20 microns and 300 microns. At this size range, the plurality of channels 18 act as capillaries or capillary channels and convey liquid aerosol-forming substrate to the mesh heating element 12 by capillary action.

Figure 3:
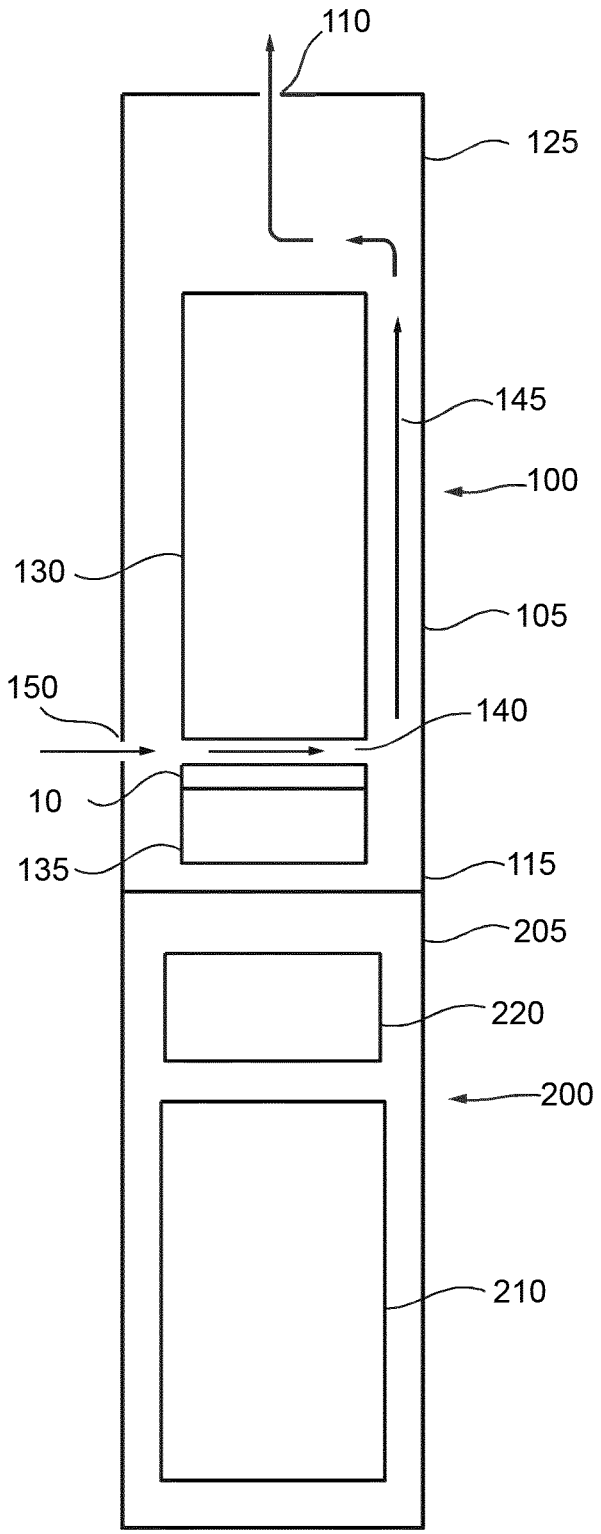
FIG. 3 is a schematic illustration of an example aerosol-generating system comprising a cartridge and an aerosol-generating device.

FIG. 3 is a schematic illustration of an example aerosol-generating system. The aerosol-generating system comprises two main components, a cartridge 100 and a main body part or aerosol-generating device 200. A connection end 115 of the cartridge 100 is removably connected to a corresponding connection end 205 of the aerosol-generating device 200. The connection end 115 of the cartridge 100 and connection end 205 of the aerosol-generating device 200 each have electrical contacts or connections (not shown) which are arranged to cooperate to provide an electrical connection between the cartridge 100 and the aerosol-generating device 200. The aerosol-generating device 200 contains a power source in the form of a battery 210, which in this example is a rechargeable lithium ion battery, and control circuitry 220. The aerosol-generating system is portable and has a size comparable to a conventional cigar or cigarette. A mouthpiece 125 is arranged at the end of the cartridge 100 opposite the connection end 115.

The cartridge 100 comprises a housing 105 containing the heater assembly 10 of FIGS. 1 and 2 and a liquid storage compartment or portion having a first storage portion 130 and a second storage portion 135. A liquid aerosol-forming substrate is held in the liquid storage compartment. Although not illustrated in FIG. 1, the first storage portion 130 of the liquid storage compartment is connected to the second storage portion 135 of the liquid storage compartment so that liquid in the first storage portion 130 can pass to the second storage portion 135. The heater assembly 10 receives liquid from the second storage portion 135 of the liquid storage compartment. At least a portion of the ceramic transport material of heater assembly 10 extends into second storage portion 135 of the liquid storage compartment to contact the liquid aerosol-forming substrate therein.

An air flow passage 140, 145 extends through the cartridge 100 from an air inlet 150 formed in a side of the housing 105 past the mesh heating element of the heater assembly 10 and from the heater assembly 10 to a mouthpiece opening 110 formed in the housing 105 at an end of the cartridge 100 opposite to the connection end 115.

The components of the cartridge 100 are arranged so that the first storage portion 130 of the liquid storage compartment is between the heater assembly 10 and the mouthpiece opening 110, and the second storage portion 135 of the liquid storage compartment is positioned on an opposite side of the heater assembly 10 to the mouthpiece opening 110. In other words, the heater assembly 10 lies between the two portions 130, 135 of the liquid storage compartment and receives liquid from the second storage portion 135. The first storage portion 130 of the liquid storage compartment is closer to the mouthpiece opening 110 than the second storage portion 135 of the liquid storage compartment. The air flow passage 140, 145 extends past the mesh heating element of the heater assembly 10 and between the first 130 and second 135 portions of the liquid storage compartment.

The aerosol-generating system is configured so that a user can puff or draw on the mouthpiece 125 of the cartridge to draw aerosol into their mouth through the mouthpiece opening 110. In operation, when a user puffs on the mouthpiece 125, air is drawn through the airflow passage 140, 145 from the air inlet 150, past the heater assembly 10, to the mouthpiece opening 110. The control circuitry 220 controls the supply of electrical power from the battery 210 to the cartridge 100 when the system is activated. This in turn controls the amount and properties of the vapour produced by the heater assembly 10. The control circuitry 220 may include an airflow sensor (not shown) and the control circuitry 220 may supply electrical power to the heater assembly 10 when user puffs are detected by the airflow sensor. This type of control arrangement is well established in aerosol-generating systems such as inhalers and e-cigarettes. When a user puffs on the mouthpiece opening 110 of the cartridge 100, the heater assembly 10 is activated and generates a vapour that is entrained in the air flow passing through the air flow passage 140. The vapour cools within the airflow in passage 145 to form an aerosol, which is then drawn into the user's mouth through the mouthpiece opening 110.

In operation, the mouthpiece opening 110 is typically the highest point of the system. The construction of the cartridge 100, and in particular the arrangement of the heater assembly 10 between first and second storage portions 130, 135 of the liquid storage compartment, is advantageous because it exploits gravity to ensure that the liquid substrate is delivered to the heater assembly 10 even as the liquid storage compartment is becoming empty, but prevents an oversupply of liquid to the heater assembly 10 which might lead to leakage of liquid into the air flow passage 140.

Figure 4:
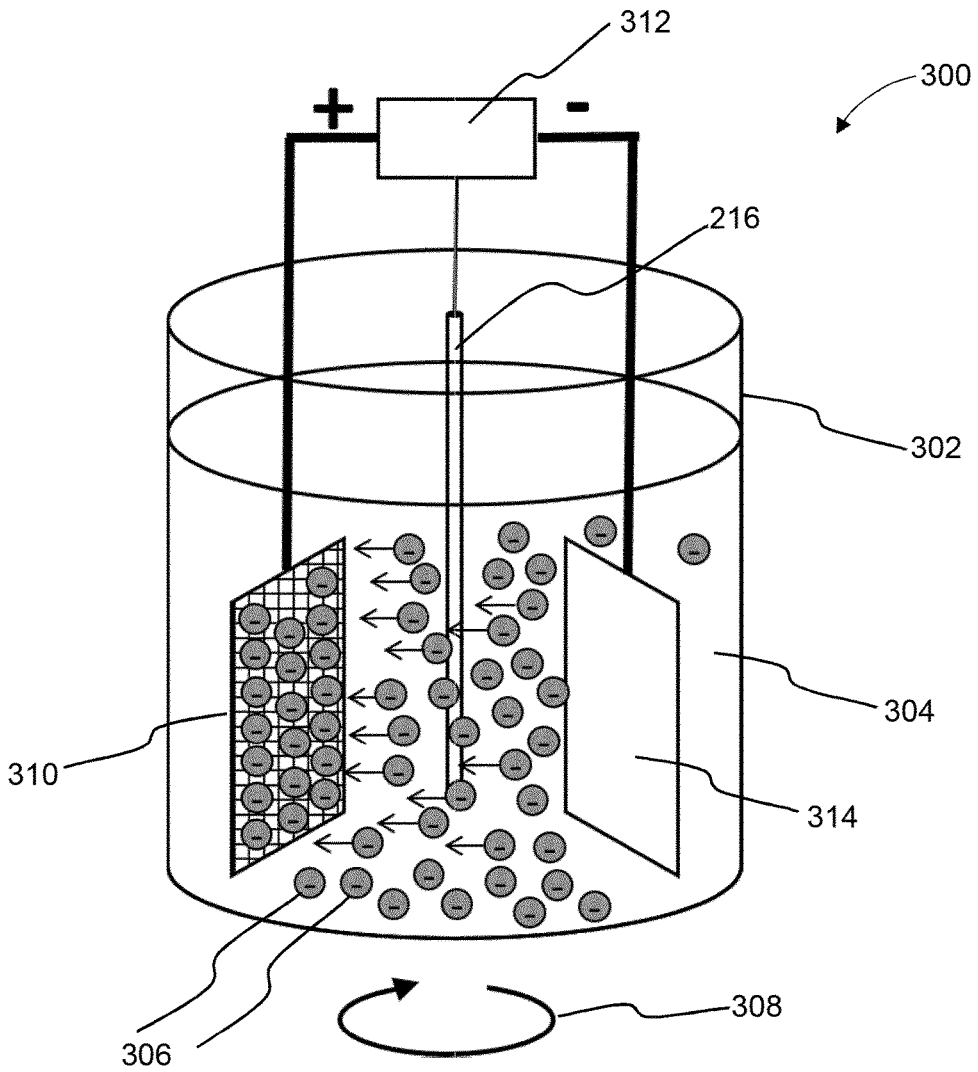
FIG. 4 is a schematic illustration of apparatus used for electrophoretic deposition.

FIG. 4 is a schematic illustration of an apparatus 300 used for the electrophoretic deposition of a ceramic transport material on a mesh heating element. The apparatus 300 comprises a container 302 holding a suspension 304 of ceramic particles 306 in a solvent at low pH. The ceramic particles 306 are charged so that they move under the application of an electric field. In the present example, the ceramic particles 306 are negatively charged. The ceramic particles 306 are kept well dispersed throughout the solvent by magnetic stirring 308. In addition, additives (not shown) such as dispersing or stabilizing agents are generally added to prevent agglomeration or flocculation.

The electrically conductive stainless steel mesh heating element 310 is immersed in the ceramic suspension 304 and connected to the positive terminal of a power supply 312. The mesh heating element forms a working electrode and provides a target substrate onto which the ceramic particles 306 can be deposited. A counter electrode 314, disposed opposite to the mesh heating element 310, is also immersed in the ceramic suspension 304 and connected to the negative terminal of the power supply 312 such that it has the opposite polarity to the mesh heating element 310. In addition, a reference electrode 316 is inserted into the ceramic suspension 304. The reference electrode 316 has a stable and well-defined potential and can be used as a reference for measuring the relative potentials of the mesh heating element 310 and counter electrode so that the voltages applied can be accurately controlled.

A voltage is applied between the mesh heating element 310 and the counter electrode 314 by the power supply 312 such that the negatively-charged ceramic particles 306 move towards the positively charged mesh heating element 310 under the action of an applied electric field. The ceramic particles 306 impact the surface of the mesh heating element 310 and form a layer of deposited ceramic. As the electrophoretic deposition continues the thickness of the ceramic layer increases and a transport material with unidirectional channels the size of the apertures in the mesh heating element 310 is formed. Following deposition, the obtained ceramic layer is annealed and sintered at high temperatures, as discussed in more detail below.

Figure 5A:
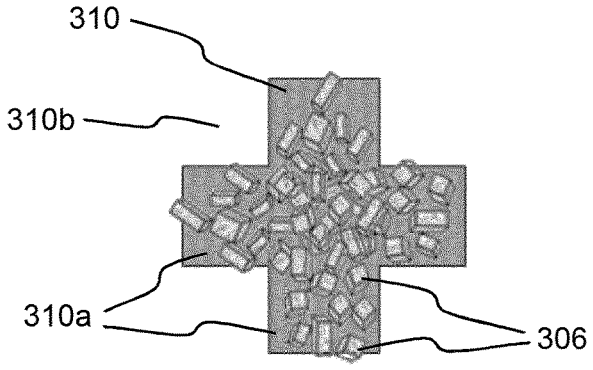
FIG. 5A is a schematic illustration of electrophoretic deposition of ceramic particles on a part of a mesh heater in accordance with an example of the present disclosure.

FIG. 5A is a schematic illustration showing a layer of ceramic particles 306 which has been deposited by electrophoretic deposition on a part of a mesh heating element 310. The ceramic particles 306 are only deposited on the filaments 310*a* of the mesh heating element 310. The layer of ceramic particles 306 does not extend into the interstices or apertures 310*b* to the sides of the filaments 310*a*, which are left vacant and ultimately form the channels in the ceramic transport material.

Figure 5B:
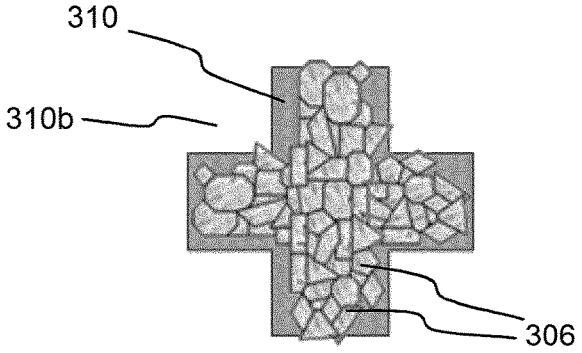
FIG. 5B is a schematic illustration showing the ceramic particles of FIG. 4A following a sintering process.

FIG. 5B is a schematic illustration showing the ceramic particles 306 of FIG. 5A following a sintering process. As can be seen in FIG. 5B, sintering has caused the ceramic particles 306 to coalesce and the pores or spaces between the ceramic particles to be reduced. This assists in reducing lateral flow of liquid aerosol-forming substrate out of the channels through the body of the ceramic and instead maintains the liquid aerosol-forming substrate in the channels so that the liquid efficiently flows in the channel to its respective aperture 310*b* in the mesh heating element 310.

Any suitable ceramic may be used to deposit the transport material. For example, inert ceramics such as $Al_2O_3$ and $ZrO_2$ may be used. Alternatively, bio-compatible ceramics such as hydroxyapatite may be used. An advantage of both these types of ceramic is that they reduce the risk of toxic compounds or unwanted by-products being produced.

Examples showing the materials and process conditions required to deposit ceramics on mesh heating elements by electrophoresis are provided below.

EXAMPLE 1

| | |
|---|---|
| Ceramic type: | $Al_2O_3$ and/or $ZrO_2$ |
| Particle size: | 0.2 to 0.7 microns |
| Particle concentration: | 0.5 to 50 weight-for-weight percentage |
| Solvent: | ethanol, isopropanol, water |
| Stabilizers/Additives: | polyethyleneimine (PEI), monochloroacetic acid, carbonic anionic based polyelectrolyte, polyvinylbutyral (PVB), acetic acid, $MgCl_2$, $AlCl_3$, n-butylamine, iodine |
| pH: | 2.2 to 5.7 |
| Voltage: | 20 to 600 volts for 4 to 60 minutes |
| Annealing conditions: | 800° C. for 1 hour |
| Sintering conditions: | 1500 to 1550° C. for 2 to 6 hours |

EXAMPLE 2

| | |
|---|---|
| Ceramic type: | hydroxyapatite |
| Particle size: | 50 to 600 nanometres |
| Particle concentration: | 2 to 10 weight-for-weight percentage |
| Solvent: | ethanol, dimethylformamide (DMF), menthol, isopropanol |
| Stabilizers/Additives: | polyvinyl alcohol (PVA), carboxylmethil cellulose |
| pH: | 4.0 to 5.3 |
| Voltage: | 5 to 200 volts for 1 to 10 minutes |
| Annealing conditions: | n/a |
| Sintering conditions: | 800 to 1300° C. for 2 hours |

The invention claimed is:

1. A heater assembly for an aerosol-generating system, the heater assembly comprising:

a fluid permeable heating element configured to heat a liquid aerosol-forming substrate to form an aerosol, the fluid permeable heating element comprising a plurality of apertures configured to allow fluid to permeate through the fluid permeable heating element; and a transport material comprising a plurality of channels configured to convey a liquid aerosol-forming substrate to the plurality of apertures of the fluid permeable heating element, wherein the transport material comprises a ceramic, which is deposited directly on to a fluid permeable surface of the fluid permeable heating element, and wherein, for over 50 percent of the apertures of the fluid permeable heating element, the transport material further comprises a corresponding channel configured to convey liquid aerosol-forming substrate to its respective aperture.

2. The heater assembly according to claim 1, wherein, for each of the apertures of the fluid permeable heating element, the transport material further comprises a corresponding channel configured to convey the liquid aerosol-forming substrate to its respective aperture.

3. The heater assembly according to claim 1, wherein the transport material has a thickness defined between a first surface of the transport material and an opposing second surface of the transport material, wherein the fluid permeable heating element is arranged at the first surface and the second surface is arranged to receive liquid aerosol-forming substrate, and wherein the plurality of channels extend through the thickness of the transport material between the first and the second surfaces of the transport material.

4. The heater assembly according to claim 3, wherein the plurality of channels are arranged to permit flow of the liquid aerosol-forming substrate in a single direction between the first and the second surfaces of the transport material.

5. The heater assembly according to claim 3, wherein the plurality of channels extend substantially linearly in a direction substantially orthogonal to the first surface of the transport material.

6. The heater assembly according to claim 1, wherein each of the plurality of apertures of the fluid permeable heating element has a cross-sectional dimension between 20 microns and 300 microns.

7. The heater assembly according to claim 1, wherein transverse cross-sectional dimensions of each of the plurality of channels along a length of the channels are substantially the same as cross-sectional dimensions of the apertures of the fluid permeable heating element.

8. The heater assembly according to claim 1, further comprising electrical contacts configured to supply electrical power to the fluid permeable heating element, wherein the electrical contacts are directly connected to the fluid permeable heating element.

9. The heater assembly according to claim 1, wherein the fluid permeable heating element is substantially flat.

10. The heater assembly according to claim 1, wherein the fluid permeable heating element further comprises a mesh heater comprising a plurality of intersecting heating filaments.

11. A cartridge for an aerosol-generating system, the cartridge comprising a heater assembly according to claim 1 and a liquid storage portion configured to hold a liquid aerosol-forming substrate.

12. An aerosol-generating system, comprising:

a cartridge according to claim 11; and an aerosol-generating device, wherein the cartridge is removably coupled to the aerosol-generating device, and wherein the aerosol-generating device comprises a power supply for the heater assembly.

13. A method of manufacturing a heater assembly for an aerosol-generating system, the method comprising:

providing a fluid permeable heating element, and providing a transport material for transporting liquid aerosol-forming substrate to the fluid permeable heating element, wherein the transport material is provided by depositing a ceramic directly on the fluid permeable heating element, and wherein the transport material is directly deposited on to the fluid permeable heating element by electrophoretic deposition.

14. The method according to claim 13, wherein the transport material is deposited by depositing ceramic particles on to the fluid permeable heating element, and wherein an average particle size of the ceramic particles is between 0.05 microns and 0.7 microns.

15. The method according to claim 13, further comprising sintering the heater assembly after the transport material has been deposited.

* * * * *